United States Patent [19]

Eskeli

[11] 4,107,944

[45] Aug. 22, 1978

[54] HEAT PUMP WITH TWO ROTORS

[76] Inventor: Michael Eskeli, 7994-41 Locke Lee, Houston, Tex. 77042

[21] Appl. No.: 759,075

[22] Filed: Jan. 13, 1977

Related U.S. Application Data

[63] Continuation-in-part of Ser. No. 407,665, Nov. 18, 1973, Pat. No. 4,047,392, Ser. No. 591,881, Jun. 30, 1975, abandoned, and Ser. No. 618,456, Oct. 1, 1975, Pat. No. 4,005,587.

[51] Int. Cl.[2] ..... F25B 3/00

[52] U.S. Cl. ..... 62/401; 62/501; 165/88; 165/DIG. 12

[58] Field of Search ..... 62/401, 499, 86, 501; 60/650, 682; 165/86, 88, DIG. 12

[56] References Cited

U.S. PATENT DOCUMENTS

| | | | |
|---|---|---|---|
| 2,490,064 | 12/1949 | Kollsman | 62/401 |
| 2,490,065 | 12/1949 | Kollsman | 62/86 |
| 2,520,729 | 8/1950 | Kollsman | 62/401 |
| 2,597,249 | 5/1952 | Kollsman | 60/682 |
| 3,470,704 | 10/1969 | Kantor | 62/499 |
| 3,834,179 | 9/1974 | Eskeli | 62/86 |
| 3,861,147 | 1/1975 | Eskeli | 165/86 |
| 3,889,471 | 6/1975 | Eskeli | 60/682 |
| 3,895,491 | 7/1975 | Eskeli | 60/682 |
| 3,919,845 | 11/1975 | Eskeli | 165/88 |
| 3,931,713 | 1/1976 | Eskeli | 60/650 |
| 4,005,587 | 2/1977 | Eskeli | 62/499 |
| 4,044,824 | 8/1977 | Eskeli | 62/499 |

*Primary Examiner*—Charles J. Myhre
*Assistant Examiner*—Sheldon Richter

[57] ABSTRACT

A method and apparatus for generating heating and cooling by circulating a working fluid within passageways carried by rotors, compressing said working fluid therewithin and removing heat from said working fluid in a heat removal heat exchanger and adding heat into said working fluid in a heat addition heat exchanger, all carried by said rotors. The working fluid is sealed within, and may be a suitable gas, such as nitrogen. A working fluid heat exchanger is also provided to exchange heat within rotor between two streams of said working fluid. In one arrangement, the unit uses two rotors, both rotating; in an alternate arrangement, one of the rotors may be held stationary. Applications include air conditioning service, and heating applications.

8 Claims, 3 Drawing Figures

HEAT PUMP WITH TWO ROTORS

CROSS REFERENCES TO RELATED APPLICATIONS

This application is a continuation-in-part application of "Dual Rotor Heat Exchanger" filed Nov. 18, 1973, Ser. No. 407,665, now U.S. Pat. No. 4,047,392. This application also is a continuation-in-part of "Heat Pump" filed June 30, 1975, Ser. No. 591,881, now abandoned. And this application also is a continuation-in-part of "Rotary Heat Exchanger with Cooling and Regeneration" filed Oct. 1, 1975, Ser. No. 618,456, now U.S. Pat. No. 4,005,587.

BACKGROUND OF THE INVENTION

This invention relates generally to devices for heat transfer from a lower temperature to a higher temperature by using a working fluid inclosed within a centrifuge rotor as an intermediate fluid to transport the heat.

Heat pumps have been known in the past but are complex and costly, and usually use a working fluid that is evaporated and condensed, which results in poor efficiency, and thus high energy cost.

SUMMARY OF THE INVENTION

It is an object of this invention to provide apparatus that is low in initial cost and has high thermal efficiency thus reducing cost of the power required to run it. It is further the object of this invention to provide a device and process wherein the losses that normally occur in bearings and seals, due to friction, are applied to the working fluid for its circulation, thus in effect eliminating the power loss due to such friction losses. Also, it is an onject of this invention to provide the rotor with a working fluid heat exchanger to reduce needed rotor speeds.

DESCRIPTION OF PREFERRED EMBODIMENTS

Figure 1:
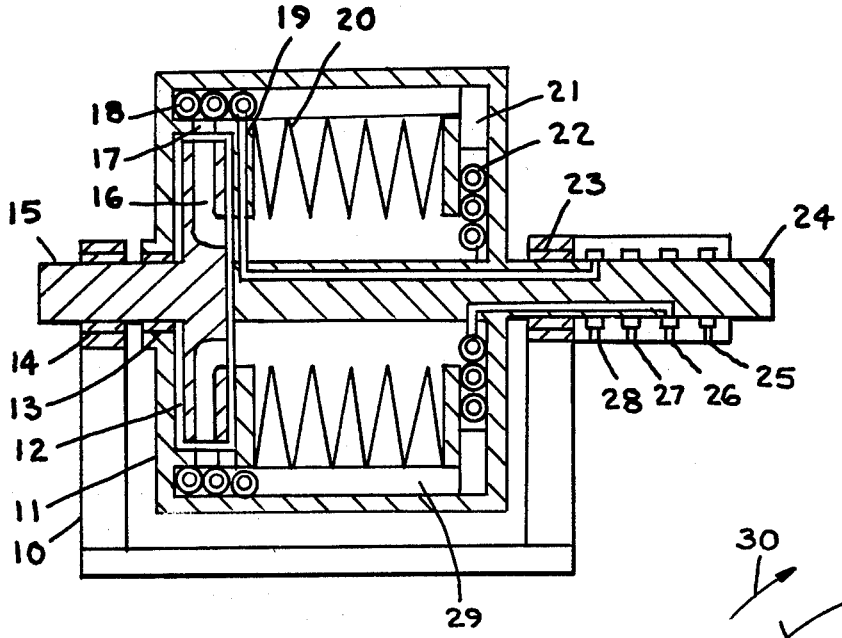
FIG. 1 is a cross section of the device.

Referring to FIG. 1, there is shown an axial cross section of the device. 10 is base, 11 is first rotor, 12 is second rotor, 13 is seal and bearing, 14 is bearing supporting shaft 15, 16 is fluid passage in second rotor, 17 is working fluid opening which may be a nozzle, 18 is first heat exchanger for heat removal from working fluid, 19 is first heat transfer fluid conduit, 20 is working fluid heat exchanger, in this instance formed from sheet metal like bellows, 21 are vanes, 22 is second heat exchanger for heat addition to working fluid, 23 is bearing supporting shaft 24, 25 and 26 are entry and exit for second heat transfer fluid, 27 and 28 are entry and exit for first heat transfer fluid, and 29 is a vane in peripheral passage.

Figure 2:
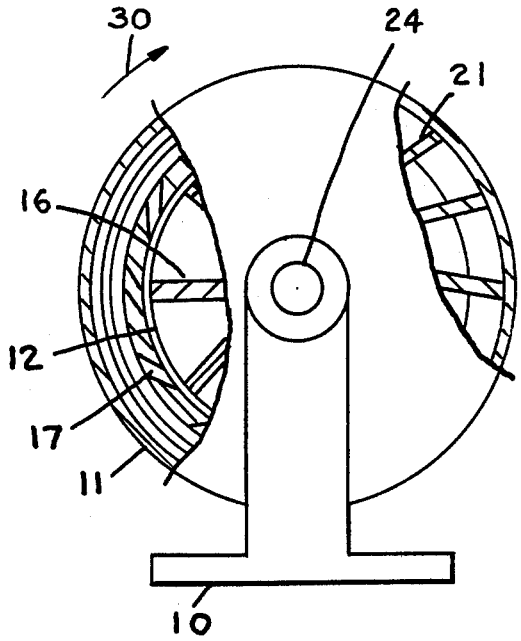
FIG. 2 is an end view of the device.

In FIG. 2, an end view of the unit shown in FIG. 1 is illustrated. 10 is base, 11 is first rotor, 17 are fluid openings, 12 is second rotor, 16 are second rotor fluid passages with vanes, 30 indicates direction of rotation, 24 is first rotor shaft, and 21 are vanes.

Figure 3:
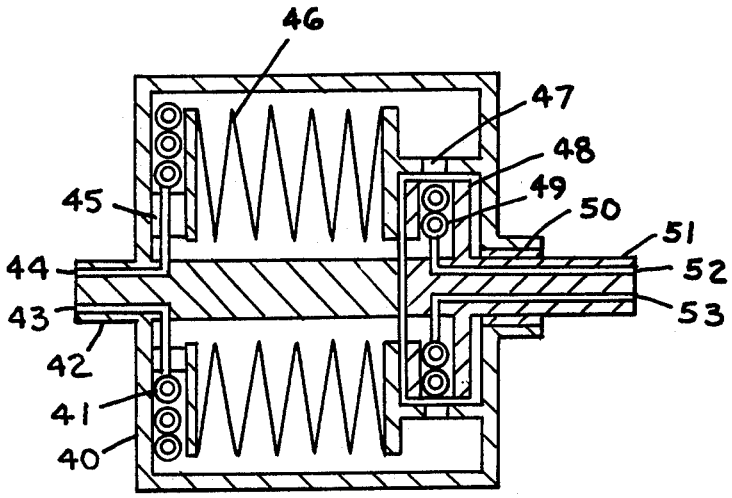
FIG. 3 is an axial cross section of another form of the device.

In FIG. 3, the rotors are arranged differently, but perform the same functions, approximately, as in the unit of FIG. 1. 40 is first rotor, 41 is first heat exchanger for heat removal from first fluid, 42 is first rotor shaft, 43 ans 44 are entry and exit for first heat transfer fluid, 45 is conduit, 46 is working fluid heat exchanger, 47 are fluid openings which may be nozzles, 48 is second rotor, 49 is second heat exchanger for adding heat to the working fluid, 50 is bearing and seal, 51 is second rotor shaft, 52 and 53 are entry and exit for second heat transfer fluid.

In operation, the rotors are caused to rotate and the rotor cavities are filled with a suitable working fluid, which is usually a gas, such as nitrogen, air or other gaseous or vapor substance. Referring to FIG. 1, the second rotor rotates usually faster than the first rotor, and the working fluid is compressed by centrifugal force in passages 16, and also in the first rotor to some extent, after which heat is removed in heat exchanger 18, with such heat then being transported by the first heat transfer fluid out of the device. The working fluid then passes along the peripheral passage 29 and releases heat in heat exchanger 20, after which the fluid is expanded against centrifugal force in vanes 21 and in heat exchanger 22 where heat is added to the working fluid. After expansion, the working fluid passes along center passage and receives heat from heat heat exchanger 20, thus completing its work cycle.

The operation of the unit in FIG. 3 is similar, except that the second rotor usually rotates slower than the first rotor, and also, the second rotor may be kept stationary, if desired. Note that if the second rotor is held stationary, one may use dirty water as the second heat transfer fluid; normally, in rotating heat exchangers, the heat transfer fluid must be free of solids, which will collect in the heat exchanger due to centrifugal force, and block the heat exchanger, and by having a stationary heat exchanger, ordinary water may be used, such as water from a cooling tower.

In the unit of FIG. 1, the power input is normally to the second rotor, and the first rotor is allowed to rotate freely. In such usage, the rotor diameters are selected to provide, together with the friction loss in bearings, for the needed speed differential between the two rotors. With the second rotor rotating faster, necessary push for the working fluid is provided to keep the working fluid circulating. Alternately, the speed differential may be maintained by using a power transmission between the two rotors, such as a gearbox. In the unit of FIG. 3, the second rotor speed is slower than the speed of the first rotor, and where the rotor diameters are suitable, the second rotor may be held stationary, providing needed push for the working fluid for its circulation.

The working fluid heat exchanger 20 and 46, employ centrifugal force and varying gas density to obtain heat exchange between the two working fluid streams. Hot gas in the peripheral passage is lighter, and colder gas between the folds of the heat exchanger is colder, thus the cold gas is displaced by lighter gas by centrifugal force. Similarly, at the center passage, cold gas at center displaces hot gas between folds. Other types of heat exchangers may be used for the heat exchanger 20, including heat pipes, sheet metal discs, and finned tubing filled with a liquid.

The rotor may be encased within a vacuum tank, if desired, to reduce friction on rotor outer surfaces. The use of the working fluid heat exchanger 20 will reduce required rotor speeds to obtain required temperature differentials between the two heat transfer fluids, which then reduces friction losses on the rotor, which may eliminate the need for a vacuum tank.

Various modifications of this device may be made, and different types of heat exchangers used. Also, working fluid radial passages may be curved in various directions, one being the slope for vanes shown in FIG. 2, item 21. By using vane slopes and sloped passages, one can adjust the amount of work exchange between the working fluid and the rotor. Nozzles 47 are usually oriented to discharge backward, to generate some torque on the first rotor; similar nozzles may be also used in passages 21 of the unit of FIG. 1. Further, the heat exchanger 22, of FIG. 1, may be mounted on a stationary member, if desired, in manner shown in FIG. 3, and also, heat exchanger 18 may be mounted within rotor 12, if desired. The various components of the units may be interchanged, as desired.

I claim:

1. In a heat pump wherein a compressible working fluid is circulated radially outwardly in a a. first fluid passage, said first passage contained in a first member, and radially inwardly toward center of rotation in a second fluid passage, said second passage contained in at least one of said first and second members, said first and second members coaxially arranged, at least one of said members being supported by a shaft for rotation;

said first and said second radial working fluid passages communicatingly connected at their respective outward ends by an outer passage and at their respective inward ends by an inner passage, said radial and outer and inner passages forming a closed loop extending at least partially through both of said members, a working fluid adapted to be circulating through said loop, means for compressing said working fluid by centrifugal force within said loop with accompanying temperature increase, first heat exchange means for cooling said working fluid after compression, said first heat exchange means being carried by one of said members, a second heat exchange means, carried by one of said members, for regeneratively exchanging heat between said working fluid within said inner and outer passages, and a third heat exchange means carried by one of said members for heating said working fluid after said heat exchange between said working fluid within said inner and outer passages.

2. The heat pump of claim 1 wherein a first heat transfer fluid is circulated within said first heat exchange means to remove heat with said first heat exchange fluid entering and leaving via conduits near the center of rotation of said members.

3. The heat pump of claim 1 wherein a second heat transfer fluid is circulated within said third heat exchange means entering and leaving via conduits near the center of rotation of said members.

4. The heat pump of claim 1 wherein both of said members are rotors.

5. The heat pump of claim 4 wherein the two rotors rotate at different angular speeds.

6. The heat pump of claim 1 wherein at least one of said members is a rotor.

7. The heat pump of claim 6 wherein said second heat exchange means includes a plurality of folds.

8. The heat pump of claim 7 wherein said second heat exchange means is of bellows configuration.

* * * * *